US005311161A

United States Patent [19]

Calder et al.

[11] Patent Number: 5,311,161

[45] Date of Patent: May 10, 1994

[54] MOLDED CASE CIRCUIT BREAKER MOTOR OPERATOR INTERFACE ASSEMBLY

[75] Inventors: William H. Calder, Plainville; Roger N. Castonguay, Terryville, both of Conn.

[73] Assignee: General Electric Company, New York, N.Y.

[21] Appl. No.: 54,628

[22] Filed: Apr. 30, 1993

[51] Int. Cl.[5] ..... H01H 3/60

[52] U.S. Cl. ..... 335/68; 335/69

[58] Field of Search ..... 335/65, 68–74

[56] References Cited

U.S. PATENT DOCUMENTS 4,042,896 8/1977 Powell et al. ..... 335/17

*Primary Examiner*—Lincoln Donovan

*Attorney, Agent, or Firm*—Richard A. Menelly

[57] ABSTRACT

A motor operator interface assembly allows a large industrial-rated circuit breaker to be manually operated between its ON and OFF conditions as well as electrically driven by a motor operator. The interface assembly includes a motor driver plate that connects and disconnects the circuit breaker operating handle from the motor operator unit to allow either manual or motor-driven operation. A drive pawl and drive plate insure resetting the circuit breaker.

14 Claims, 6 Drawing Sheets

MOLDED CASE CIRCUIT BREAKER MOTOR OPERATOR INTERFACE ASSEMBLY

BACKGROUND OF THE INVENTION

Industrial-rated circuit breakers are fitted with motor-operated devices for turning the circuit breakers ON and OFF either at the circuit breaker site or from a remote location. U.S. Pat. No. 4,042,896 describes a motor operator device that allows the circuit breaker to be conveniently converted from a motor operated-state to a manual-operated state by means of an external pushbutton and interface assembly. When the circuit breakers are engaged for motor operation, and a loss of motor control power occurs during a circuit breaker resetting function, the motor operator must be manually dissembled from the circuit breaker operating mechanism to allow the circuit breaker to be manually controlled.

When a large number of manufacturing processes are protected from a single motor-operated circuit breaker, some manufacturing down-time must occur to allow an operator to manually disengage the motor operator from the internal circuit breaker operating mechanism to manually reset the circuit breaker operating mechanism. The circuit breaker and associated electrical equipment are de-energized to protect the operator and equipment before the circuit breaker internal operating mechanism components are exposed and accessed. The motor operator is then re-connected with the circuit breaker operating mechanism. The circuit breaker automatically reverts to being controlled by the motor operator after the motor control power has been restored to the circuit breaker.

It would be economically advantageous to eliminate the requirement that the motor operator be manually dissembled from the circuit breaker operating mechanism each time such a loss of motor control power occurred. One purpose of the invention is to provide a motor operator unit with an interface assembly that would allow optional manual operation of the circuit breaker regardless of the state of the circuit breaker operating mechanism.

SUMMARY OF THE INVENTION

A motor operator unit is provided with an interface assembly between the operator and a circuit breaker operating mechanism. The interface assembly includes a motor drive plate, an operating mechanism drive plate, and a spring-driven pawl that links the operating mechanism drive plate with either the motor operator or the circuit breaker operating handle. A slot on the outer perimeter of the motor drive plate receives the pawl when such motor operation is intended and releases the pawl for manual operation.

DESCRIPTION OF THE PREFERRED EMBODIMENT

Figure 1:
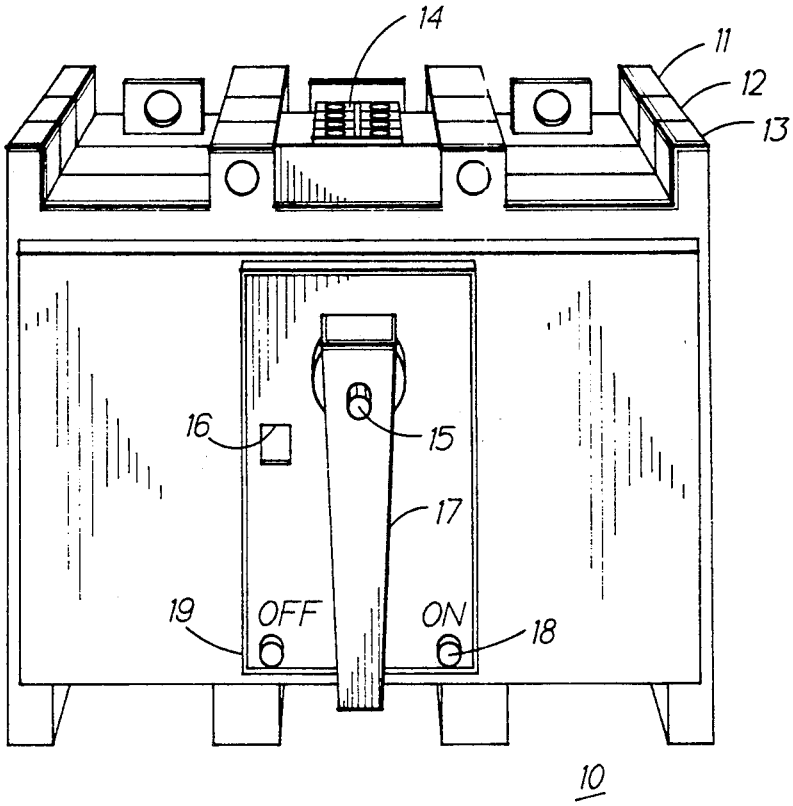
FIG. 1 is a front perspective view of a motor-operated molded case circuit breaker containing the motor operator interface assembly of the invention.
Figure 2:
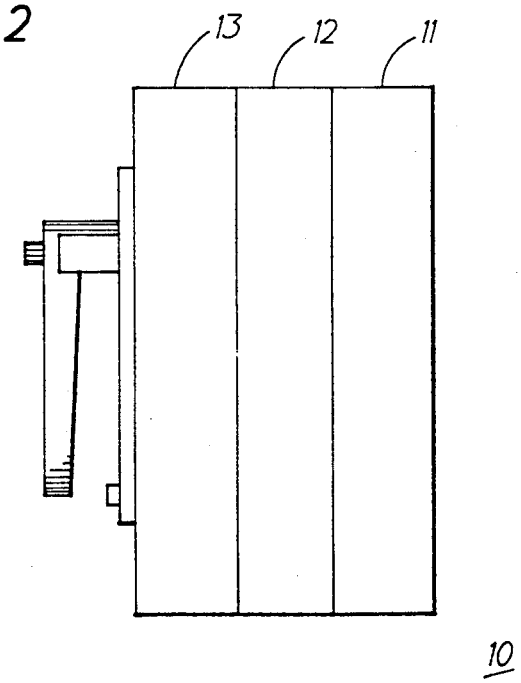
FIG. 2 is a side view of the circuit breaker of FIG. 1.

A power-operated circuit breaker 10 as shown in FIGS. 1 and 2 includes a circuit breaker assembly 11, power unit assembly 12 and cover assembly 13, all as described in the aforementioned U.S. Pat. No. 4,042,896. The terminal strip 14 on top of the motor-controlled circuit breaker allows connection with a remote operating switch. For local operation of the motor-operated circuit breaker, an ON button 18 and OFF button 19 on the front allows the internal motor operator power assembly 12 to be energized. To operate the motor-operated circuit breaker manually, a release button 15 disengages the motor operator from the circuit breaker operating mechanism and allows manual operation by means of the handle operator 17. The viewing window 16 allows the ON or OFF condition of the circuit breaker operating mechanism to be visually ascertained.

Figure 3:
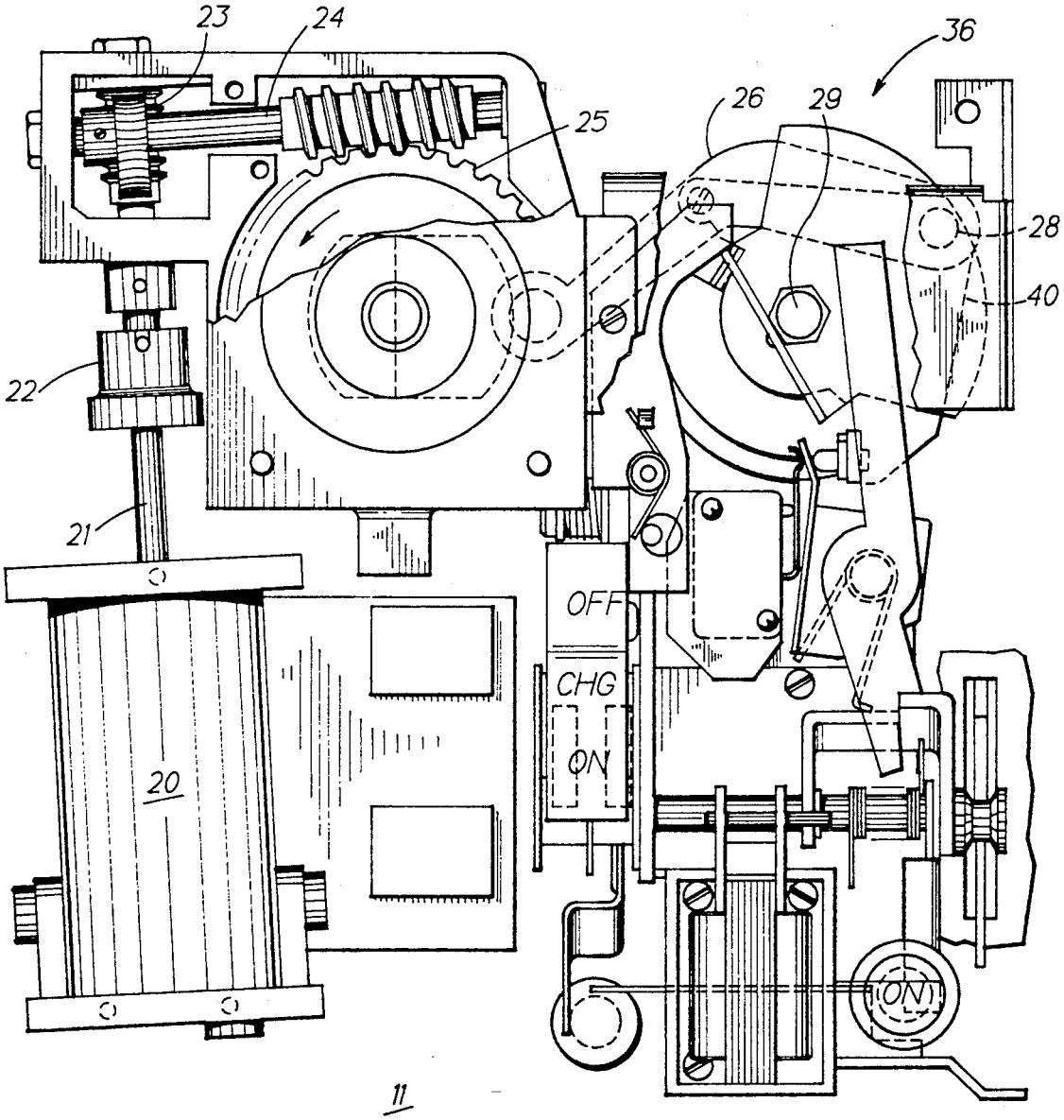
FIG. 3 is an enlarged top plan view of the motor operator unit and interface assembly within the circuit breaker of FIG. 1.

The power unit assembly 12 within the motor-controlled circuit breaker 10 is shown in FIG. 3 to consist of an electric motor 20 which connects with a gear box 23 by means of a shaft 21 and coupling 22. The worm gear 25 and drive shaft 24 connect the interface assembly 36 and motor drive link 26 in the manner described within the aforementioned U.S. Pat. No. 4,042,896. The interface assembly 36 differs from the structure contained within the aforementioned U.S. Patent in the manner to be described below in greater detail. The motor drive plate 40 connects with the link 26 by means of the actuator pin 28. The description and function of the remaining components depicted within FIG. 3, such as the operating shaft 29, are identical to those described within the aforementioned Patent.

Figure 4A:
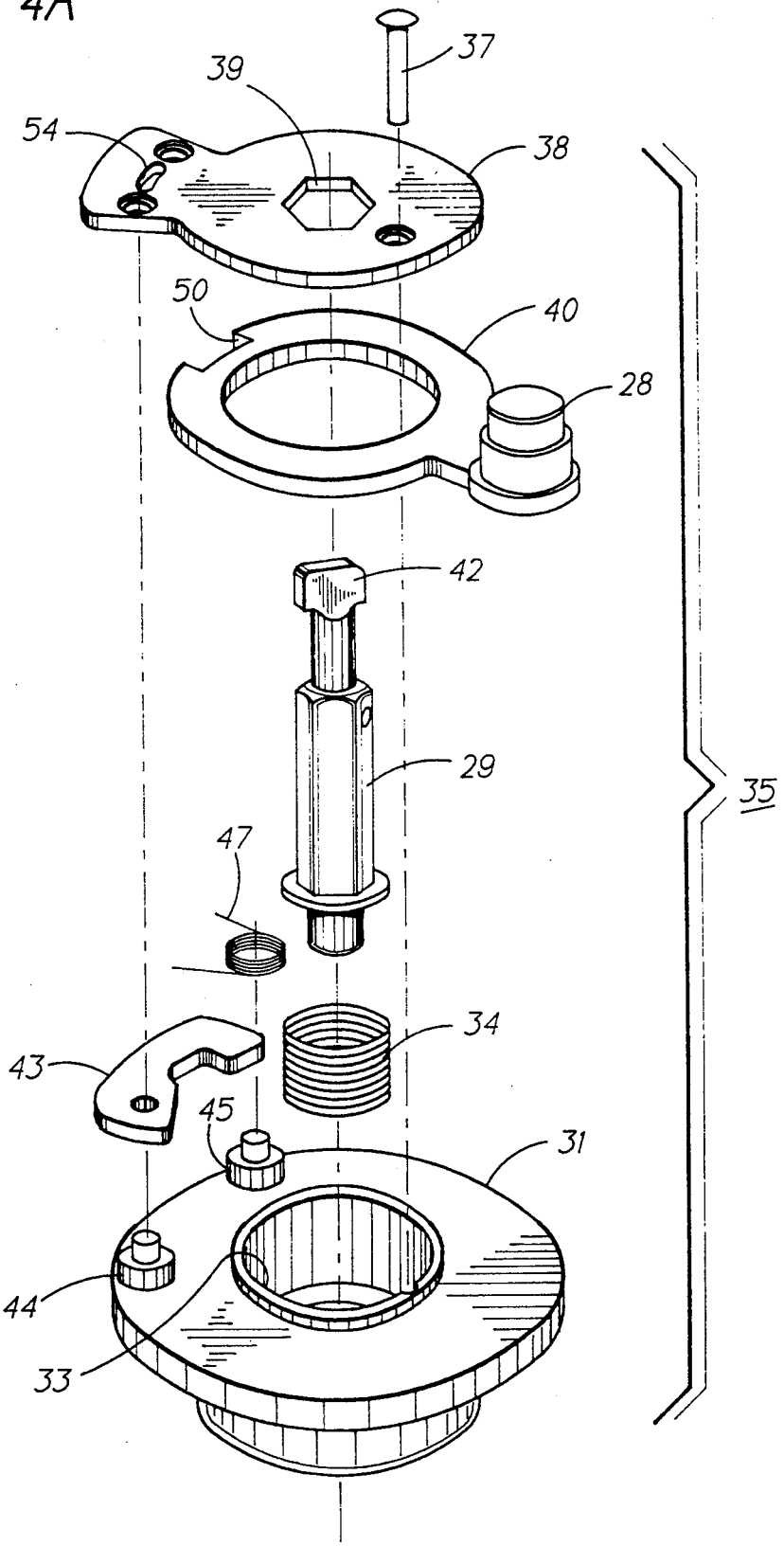
FIGS. 4A and 4B are enlarged top perspective views of the interface assembly of the invention with the components in isometric projection.
Figure 4B:
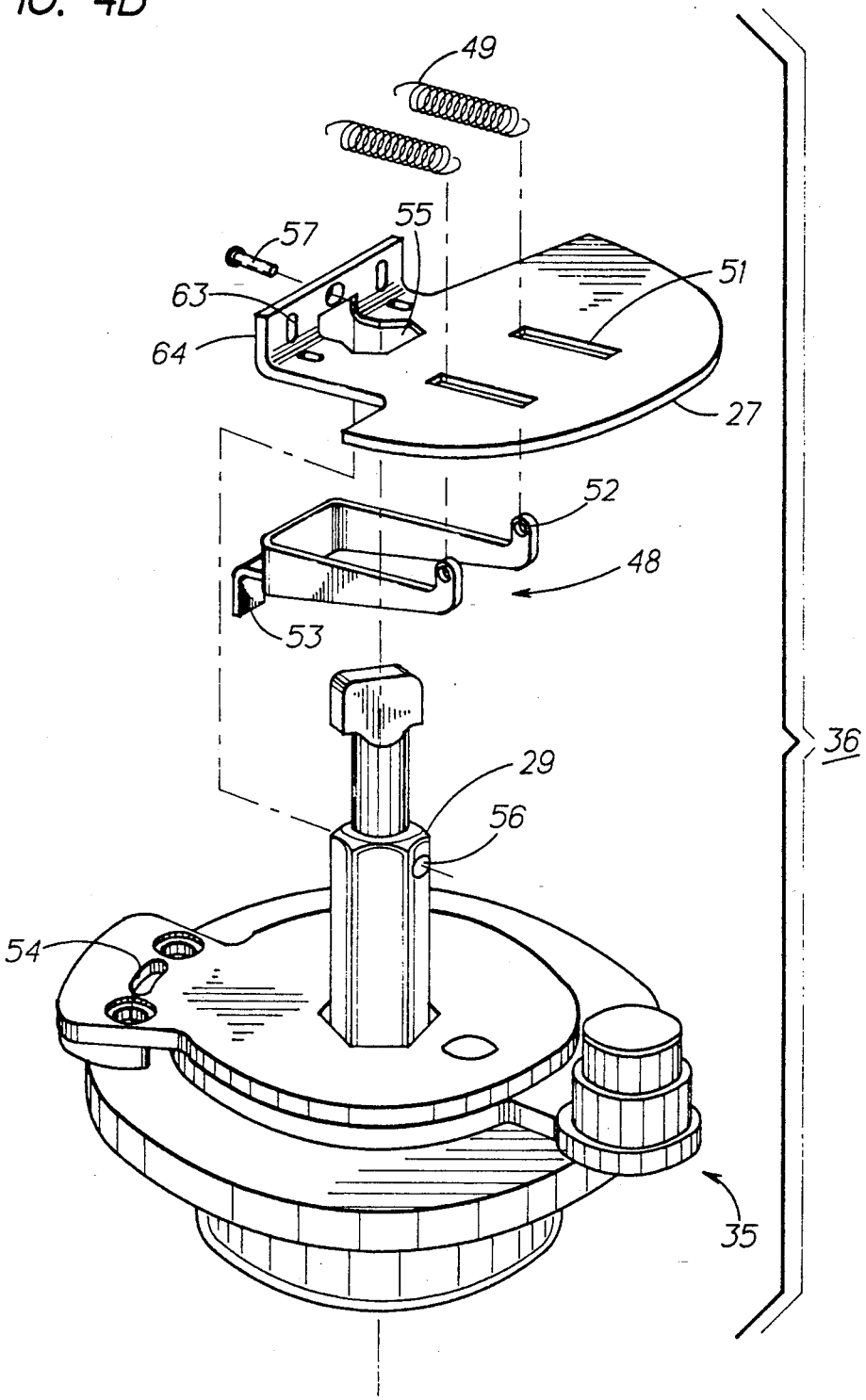

In accordance with the invention, the components of the interface assembly 36 are depicted in FIGS. 4A and 4B and include a hub assembly 35 consisting of a hub 31 containing a recess 33 in which a shaft return spring 34 is positioned. A drive pawl 43 is attached to the hub by means of the pivot stud 44 upstanding from the top of the hub and a pawl return spring 47 is mounted on the top of the hub by means of the support stud 45. The operating shaft 29 is next inserted within the hub and encircled by the motor drive plate 40 which includes a ratchet slot 50 and an actuator pin 28. The handle drive plate 38 is positioned over the operating shaft 29 by means of the hex slot 39 and is attached to the hub 31 by means of the rivet 37 and studs 44, 45. The elongated slot 54 formed in the drive plate 38 overlays the ratchet slot 50 and receives the tab 53 (FIG. 4B) extending from the disengagement link 48 into the ratchet slot. The disengagement link has a pair of up-turned arms 52 which extend within corresponding slots 51 formed on the actuator plate 27 and receive one end of each of a pair of link springs 49. The other end of the springs engage a pair of openings 63 formed in the backplate 64. The shaft 29 extends through the opening 55 formed within the actuator plate and the actuator plate is attached to the shaft by means of the screw 57 and threaded opening 56. The shaped end 42 of the shaft supports one end of the handle operator 17 shown earlier in FIG. 1.

Figure 5:
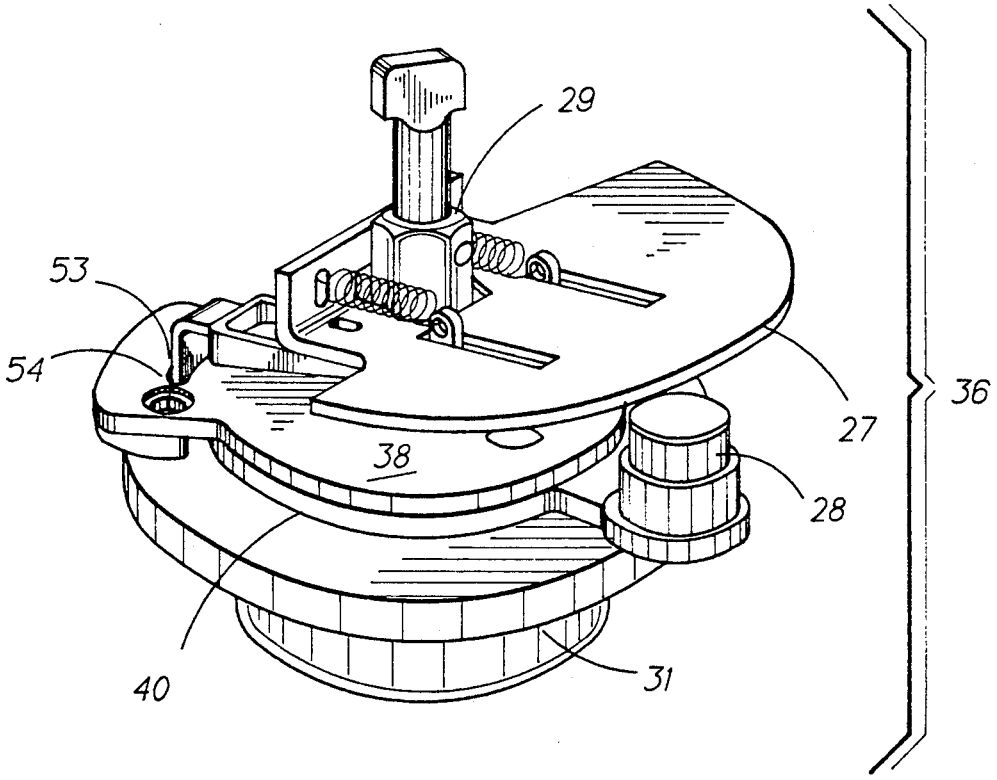
FIG. 5 is an enlarged top perspective view of the interface assembly of FIGS. 4A and 4B.

The complete interface assembly 36 is shown in FIG. 5 with the tab 53 extending downwards from the actuator plate 27 through the slot 54 in the handle drive plate 38 into abutment with the perimeter of the motor drive plate 40 which carries the actuator pin 28. The shaft 29 is seen to extend through the interface assembly down to the hub 31.

Figure 6A:
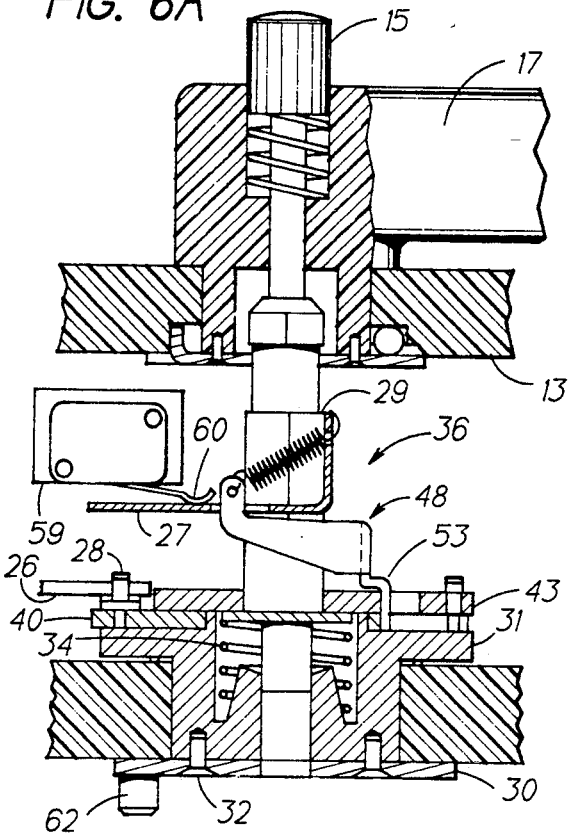
FIGS. 6A and 6B are side sectional views and top plan views respectively, of part of the circuit breaker operating handle and interface assembly of FIG. 1 with the motor control unit engaged.
Figure 6B:
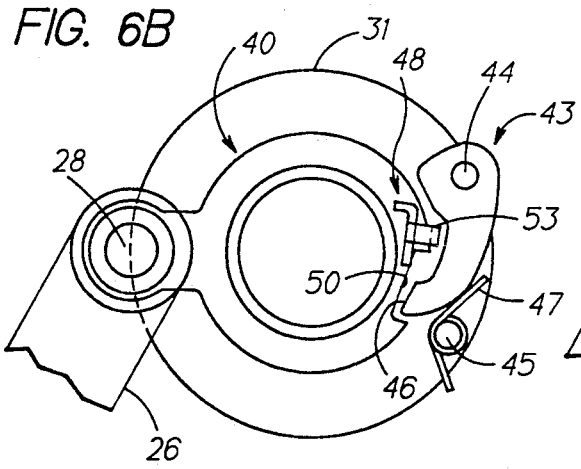

FIGS. 6A and 6B depict the operation of the interface assembly 36 when the power unit assembly is operational to control the circuit breaker operating mechanism by means of the motor actuator switch 59 turned on by upwards displacement of the switch actuator 60 by the actuator plate 27. With the handle release button 15 in the released position within the circuit breaker operating handle 17 under the bias of the shaft return spring 34, the shaft 29 extending through the cover assembly 13 allows the disengagement link 48 to remain biased by the shaft return spring 34 such that the tab 53 on the disengagement link 48 is away from the drive pawl 43. The motor drive plate 40 is rotated by connection of the link 26 with the actuator pin 28 on the motor drive plate. The rotation of the motor drive plate 40 rotates the shaft 29 and hub 31 which in turn rotates the operating mechanism drive plate 30 which is attached to the bottom of the hub by means of screws 32. The rotation of the drive plate rotates the operating mechanism pin 62 which interacts with the circuit breaker operating mechanism to reset the circuit breaker in the manner described within the aforementioned U.S. Pat. No. 4,042,896. The arrangement of the motor drive plate 40 on the hub 31 and the connection of the motor drive link 26 to the actuator pin 28 is seen in FIG. 6B with the superstructure removed to detail the interaction between the drive pawl 43, the disengagement link 48 and the motor drive plate 40. With the tab 53 away from the drive pawl 43, the engaging hook 46 on one end of the drive pawl is in abutment with the surface of the ratchet slot 50 on the perimeter of the motor drive plate and is held against the ratchet slot by the bias provided by the return spring 47 arranged on the stud 45. The drive pawl 43 is attached to the hub 31 by means of the pivot stud 44. The engagement between the engaging hook 46 and the ratchet slot 50 allows the rotation of the motor drive plate 40 and the hub 31 in unison with the motion provided by the motor connected with the link 26.

Figure 7A:
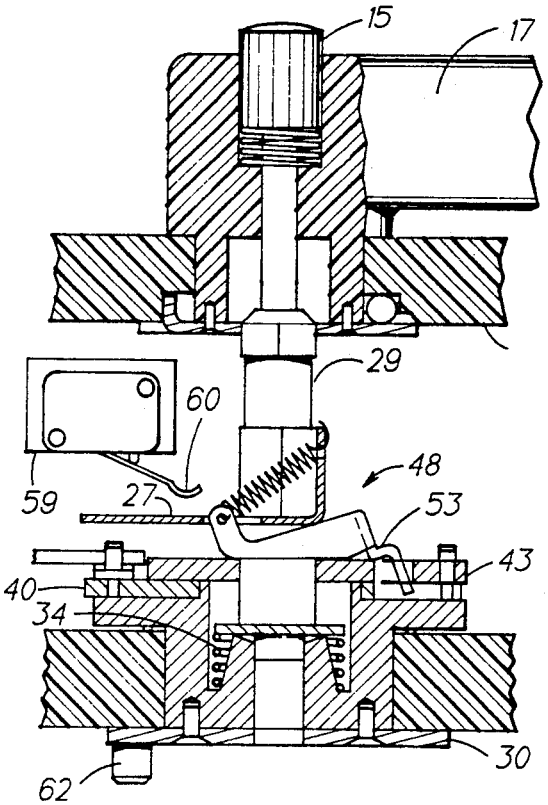
FIGS. 7A and 7B are similar side sectional and top plan views of the operating handle and interface assembly of FIGS. 6A and 6B with the circuit breaker operating handle engaged.
Figure 7B:
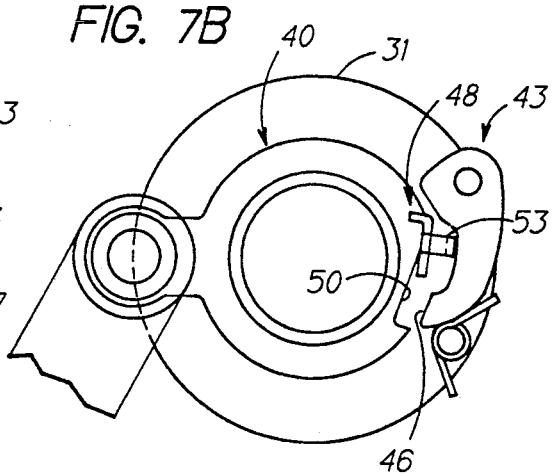

In FIGS. 7A and 7B the button 15 is depressed driving the shaft return spring 34 into compression and moving the shaft 29 in the downward direction. The actuator plate 27 is displaced from the actuator 60 allowing the motor switch 59 to turn off and rotating the tab 53 on the disengaging link 48 against the drive pawl 43. The engaging hook 46 on the end of the drive pawl 43 is driven out of the ratchet slot 50 thereby breaking the engagement between the motor drive plate 40 and the hub 31. This now allows the shaft 29 to rotate independent from the motor such that when a force is applied to the circuit breaker operating handle 17 the shaft rotates the hub 31 and the attached operating mechanism drive plate 30. The operating mechanism pin 62 on the operating mechanism drive plate 30 engages with the circuit breaker operating mechanism to reset the circuit breaker operating mechanism independent of the motor operator. Upon release of the button 15, the shaft 29 returns to the position shown in FIGS. 6A, 6B under the urgence of the shaft return spring 34 moving the actuator plate 27 back into contact with the actuator 60 on the motor actuator switch. The circuit breaker operating mechanism again becomes controlled by the motor operator.

Having thus described our invention, what we claim as new and desire to secure by Letters Patent is:

1. A motor-controlled molded case circuit breaker comprising:

a circuit breaker having an operating mechanism arranged for turning the circuit breaker between ON and OFF conditions;

an externally accessible operating handle on said circuit breaker for interacting with said operating mechanism to reset said circuit breaker operating mechanism;

a motor operator having an electric motor and an interface unit for interacting with said operating mechanism to turn said circuit breaker between ON and OFF conditions, said interface unit comprising means releasably connecting said electric motor with said operating mechanism to allow translation of said operating handle independently from said electric motor and a shaft extending from said operating handle at one end to within a hub at an opposite end, said hub being adapted for connection with said operating mechanism;

a handle drive plate attached to said hub, said handle drive plate receiving said shaft and being shaped for rotating in unison with said shaft; and a motor drive plate intermediate said handle drive plate and said hub, said motor drive plate including an actuator pin arranged for connection with a motor connector link.

2. The motor-controlled molded case circuit breaker of claim 1 including a ratchet slot formed within a perimeter of said motor drive plate.

3. The motor-controlled molded case circuit breaker of claim 2 including a switch actuator plate superjacent said handle drive plate and further including a disengagement link intermediate said handle drive plate and said switch actuator plate, a disengagement tab on a bottom of said disengagement link extending within a slot on said handle drive plate.

4. The motor-controlled molded case circuit breaker of claim 3 including a pair of arms extending from a top of said disengagement link and passing within a pair of slots formed in said switch actuator plate.

5. The motor-controlled molded case circuit breaker of claim 2 including a spring-loaded drive pawl pivotally attached to a top of said hub, said pawl including a hook-shaped end removably-received within said ratchet slot.

6. The motor-controlled molded case circuit breaker of claim 5 whereby said disengagement tab contacts said drive pawl to move said hook-shaped end out of said ratchet slot when said shaft is depressed and whereby said disengagement tab releases said drive pawl to allow said hook-shaped end to return within said ratchet slot when said shaft is released.

7. The motor-controlled molded case circuit breaker of claim 5 including a motor switch proximate said actuator plate, said actuator plate contacting an actuator on said motor switch when said disengagement tab contacts said drive pawl and said actuator plate being away from said actuator when said disengagement tab is away from said drive pawl.

8. The motor-controlled molded case circuit breaker of claim 3 wherein said disengagement link is attached to said switch actuator plate by means of a pair of springs.

9. A motor operator-circuit breaker interface unit comprising:

means releasably connecting a circuit breaker operating handle from an electric motor for translating said operating handle independently from said electric motor;

a shaft extending from said operating handle at one end to within a hub at an opposite end, said hub adapted for connection with said operating mechanism;

a handle drive plate attached to said hub, said handle drive plate being shaped for rotating in unison with said shaft; and a switch actuator plate superjacent said handle drive plate and a disengagement link intermediate said handle drive plate and said switch actuator plate, a disengagement tab on a bottom of said disengagement link extending within a slot on said handle drive plate.

10. The motor operator-circuit breaker interface unit of claim 9 including a pair of arms extending from a top of said disengagement link within a pair of slots formed within said switch actuator plate.

11. The motor operator-circuit breaker interface unit of claim 10 including a spring-loaded drive pawl pivotally attached to a top of said hub, said pawl including a hook-shaped end removably-received within said ratchet slot.

12. The motor operator-circuit breaker interface unit of claim 11 whereby said disengagement tab contacts said drive pawl to move said hook-shaped end out of said ratchet slot when said shaft is depressed and whereby said disengagement tab releases said drive pawl to allow said hook-shaped end to return within said ratchet slot when said shaft is released.

13. The motor operator-circuit breaker interface unit of claim 10 including a motor switch proximate said actuator plate, said actuator plate contacting an actuator on said motor switch when said disengagement tab contacts said drive pawl, said actuator plate being away from said actuator when said disengagement tab is away from said drive pawl.

14. The motor operator-circuit breaker interface unit of claim 10 wherein said disengagement link is attached to said switch actuator plate by means of a pair of springs.

* * * * *